US005564166A

United States Patent [19]

Roy

[11] Patent Number: 5,564,166

[45] Date of Patent: Oct. 15, 1996

[54] BADGE CLIP ASSEMBLY INCLUDING A SPRING-BIASED CLIP MEMBER

[75] Inventor: Armand E. Roy, Attleboro, Mass.

[73] Assignee: Roy Manufacturing Co., Inc., South Attleboro, Mass.

[21] Appl. No.: 510,188

[22] Filed: Aug. 2, 1995

[51] Int. Cl.[6] ..... A44B 21/00

[52] U.S. Cl. ..... 24/3.11; 24/13; 24/24; 24/508; 24/513; 24/330; 24/335; 40/1.5

[58] Field of Search ..... 24/13, 24, 508, 24/513, 330, 335, 3.11; 40/1.5, 1.6, 666

[56] References Cited

U.S. PATENT DOCUMENTS

| | | | |
|---|---|---|---|
| 1,564,424 | 12/1925 | Lynch | 40/666 X |
| 2,618,086 | 11/1952 | Komorous | 40/1.5 |
| 2,962,824 | 12/1960 | Brooks et al. | 40/666 |
| 3,280,488 | 10/1966 | Rubin | 40/1.5 |
| 3,782,012 | 1/1974 | Price | 40/1.5 |
| 3,931,688 | 1/1976 | Owens | 40/1.5 |
| 4,228,569 | 10/1980 | Snyder | 24/252 R |
| 4,259,797 | 4/1981 | Belser | 40/1.5 |
| 4,518,080 | 5/1985 | Ohlson | 40/1.5 X |
| 5,275,282 | 1/1994 | Ross et al. | 40/666 X |
| 5,384,972 | 1/1995 | Arnt | 40/1.6 |

FOREIGN PATENT DOCUMENTS

| | | | |
|---|---|---|---|
| 4226341 | 2/1994 | Denmark | 40/1.6 |

*Primary Examiner*—Peter M. Cuomo
*Assistant Examiner*—Stephen Vu
*Attorney, Agent, or Firm*—Salter & Michaelson

[57] ABSTRACT

A badge clip secures a badge to an attaching member which enables the badge to be worn or carried by a person. The badge clip includes a fixed leg having a first end portion and an opposite second end portion with a curled barrel formation, and a movable leg having a first end portion which is reversely bent from the first end portion of the fixed leg, and an opposite second end portion which is engageable with the curled barrel formation of the fixed leg. The movable leg is pivotally movable between an open position and a closed position, the movable leg being biased to its closed position. The arrangement is such that the curled barrel formation of the fixed leg is capable of receiving a badge having an opening formed therein for securing the badge to the badge clip. The curled barrel formation is received through the opening of the badge when the movable leg is in its open position. The badge is secured to the badge clip when the movable leg resiliently returns to its closed position.

7 Claims, 4 Drawing Sheets

BADGE CLIP ASSEMBLY INCLUDING A SPRING-BIASED CLIP MEMBER

BACKGROUND AND SUMMARY OF THE INVENTION

This invention relates generally to fasteners, and more particularly to a badge clip for securing a badge, or any other similar device having information indicia printed thereon, to a clamping device, chain or the like which is worn by a person as a form of identification.

Identification badges and the like are oftentimes worn by employees of companies which require their employees to wear badges evidencing their employment. FIG. 1 illustrates a prior art badge fastener or clip, generally indicated at 20, for securing the badge (not shown) to the person's clothing or the like. As shown, the clip 20 includes a clamping device 22 of conventional construction which clamps onto an article of clothing, and a plastic strap 24 fabricated from vinyl or mylar which is fastened (as by a rivet) to the clamping device. The plastic strap 24 is flexible, and is designed for passing through an opening formed in the badge for securing the badge thereto. A pair of snap fasteners 26 attached to the strap 24 maintain the strap 24 in looped configuration around a portion of the badge for securing the badge to the strap 24. Such clips are well-known in the art.

However, the foregoing clip 20 does suffer from several shortcomings. For example, the snap fasteners 26 have a tendency to break away from the strap 24 after extended use. In a related manner, the plastic strap is subject to cracking at its curled edge which is represented at 28. Moreover, since the clip is made from several separate components (i.e., the clamping device 22, the plastic strap 24 and the snap fasteners 26), its assembly is somewhat labor intensive which increases the overall cost of the clip.

Accordingly, among the several objects of the present invention are the provision of an improved badge clip which is durable in use and capable of withstanding wear and tear without failing; the provision of such a badge clip which can be fabricated automatically and requires little or no assembly cost; the provision of such a badge clip which is easily attached to a badge; and the provision of such a badge clip which is simple in construction and cost-efficient to manufacture.

In general, the present invention is directed to a badge clip for securing a badge or any other similar device to an attaching member, such as a clamping device, which enables the badge to be worn or carried by a person. The badge clip comprises a fixed leg having a first end portion and an opposite second end portion with a curled barrel formation, and a movable leg having a first end portion secured to the first end portion of the fixed leg and an opposite second end portion engageable with the curled barrel formation of the fixed leg. The movable leg is pivotally movable between an open position in which the movable leg is adjacent the fixed leg and the second end portion of the movable leg is spaced from the curled barrel formation, and a closed position in which the movable leg is angled with respect to the fixed leg and the second end portion of the movable leg engages the curled barrel formation to effect closing thereof. Suitable means biases the movable leg to its closed position. The arrangement is such that the curled barrel formation of the fixed leg is capable of receiving a badge having an opening formed therein for securing the badge to the badge clip. The curled barrel formation is received through the opening of the badge when the movable leg is in its open position. The badge is secured to the badge clip by the biasing means which moves the movable leg to its closed position.

In a preferred embodiment, the biasing means comprises means for securing the first end portions of the fixed and movable legs together in such a manner that inwardly facing surfaces of the legs are in facing relation, and at least one detent formed on the inwardly facing surface of one of the fixed and movable legs. The detent functions as a fulcrum whereupon when pressure is applied to the legs on one side of the detent, the portion of the movable leg on the other side of the detent is resiliently flexed to bias the clip to its closed position.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
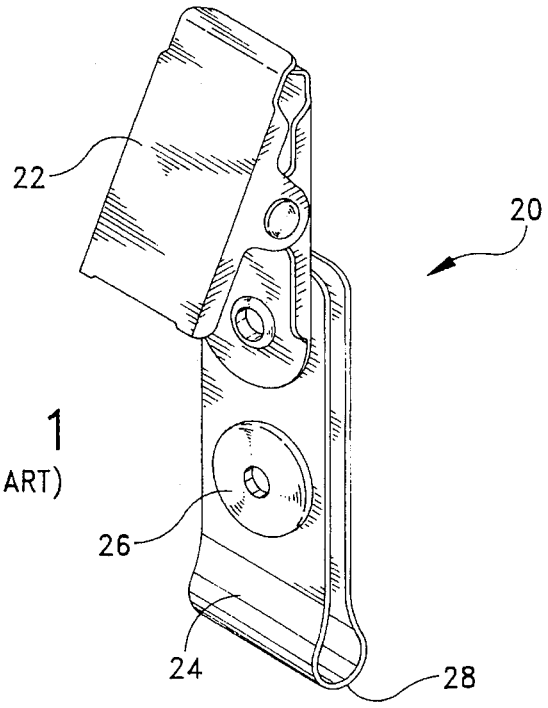
FIG. 1 (PRIOR ART)
FIG. 1 is a perspective view illustrating a prior art badge clip.
Figure 2:
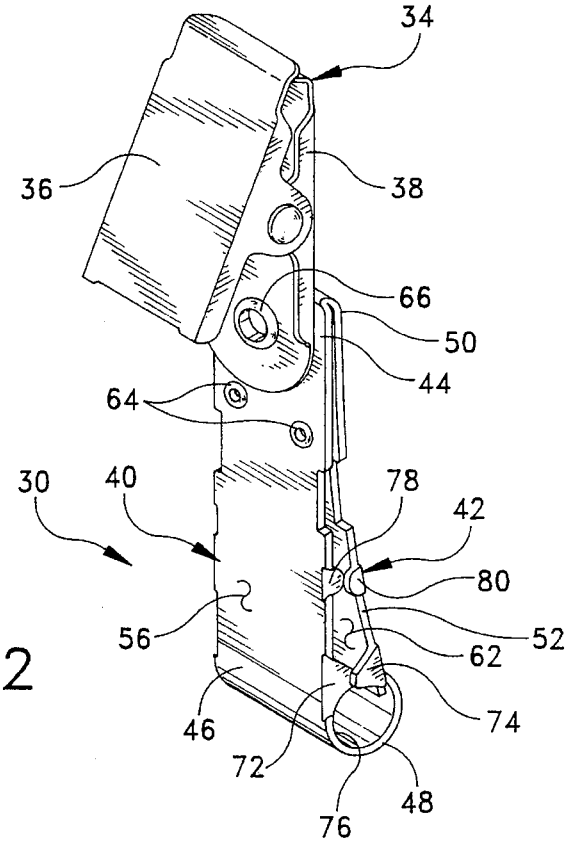
FIG. 2 is a perspective view illustrating a badge clip of the present invention attached to a clamping device.
Figure 3:
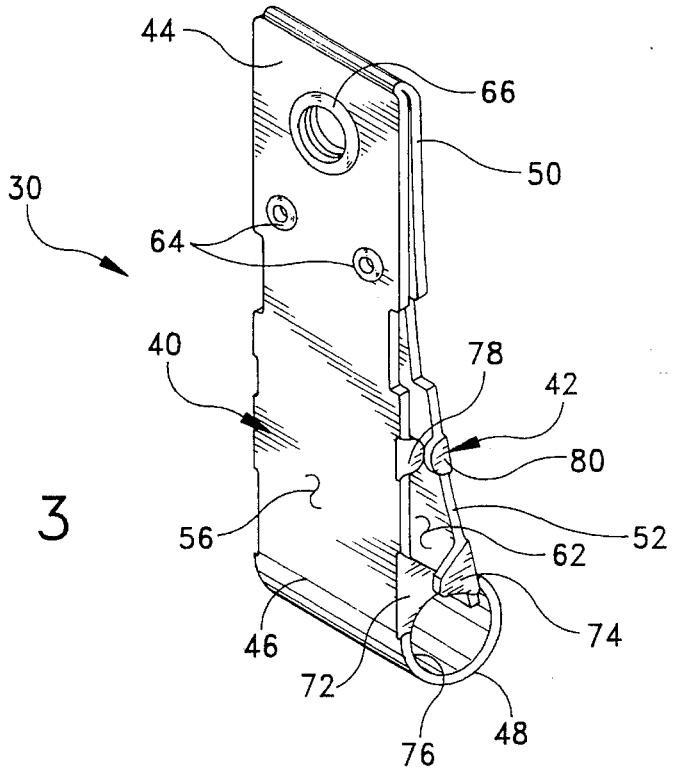
FIG. 3 is a perspective view of the badge clip per se.
Figure 4:
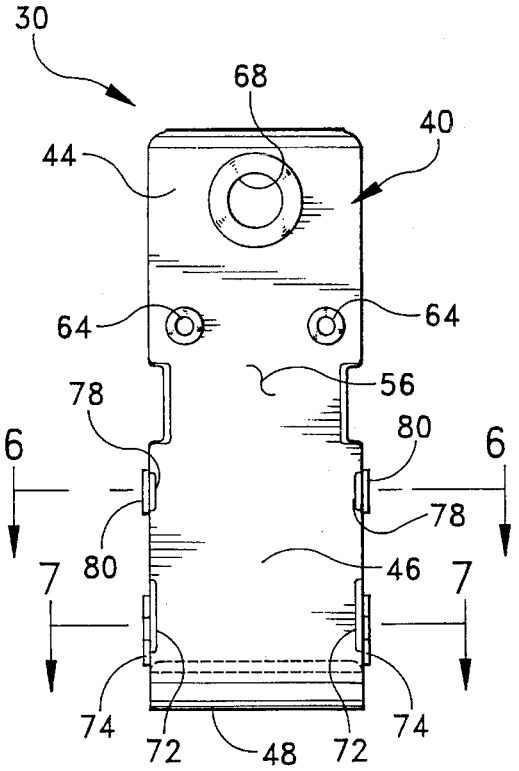
FIG. 4 is a front elevational view of the badge clip illustrated in FIG. 3.
Figure 5:
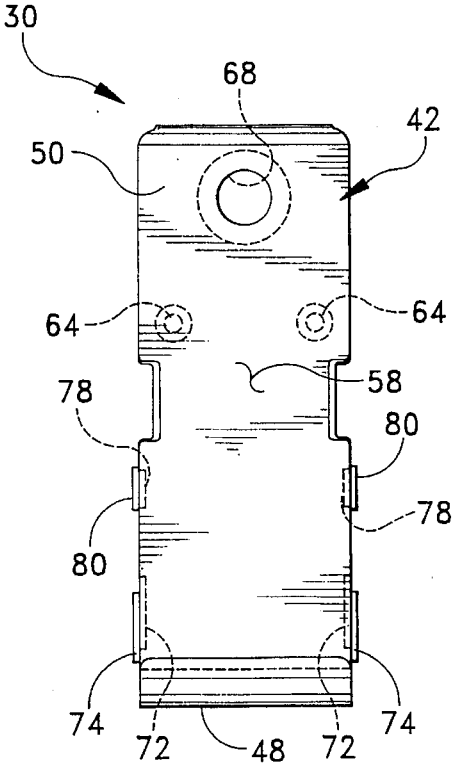
FIG. 5 is a rear elevational view thereof.
Figure 10:
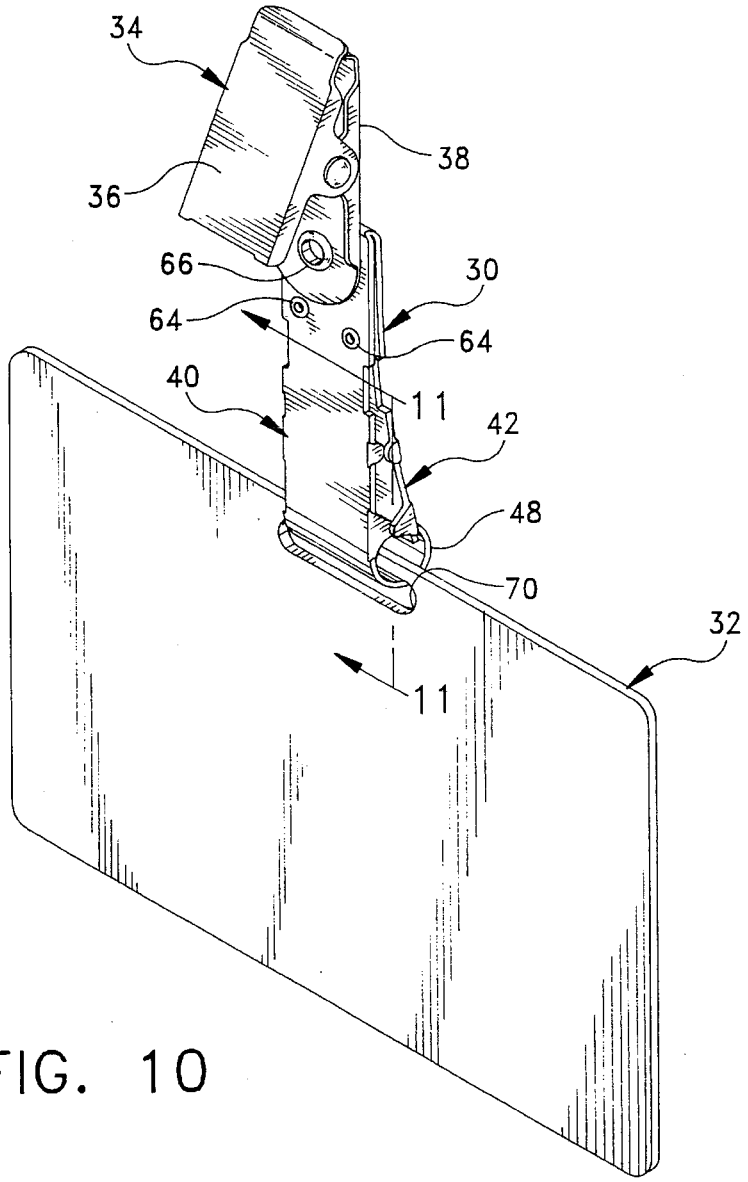
FIG. 10 is a perspective view of the badge clip secured to a badge.

Referring now to the drawings, and more particularly to FIGS. 2 and 10, there is generally indicated at 30 a badge clip of the present invention for securing a badge, generally indicated at 32, to a person. More specifically, the badge clip 30 secures the badge 32, or any other similar identification device, to an attaching member such as a clamping device which is generally indicated at 34. Such clamping devices are well-known in the art, and are adapted to clamp onto a person's clothing, for example. As shown, the clamping device 34 comprises two clamping members 36, 38 which are biased to a clamping position illustrated in FIG. 2 by a spring (not shown). Alternatively, the badge clip 30 can secure the badge 32 to other types of attaching members such as a linking element (not shown) which can be attached to a chain which may be worn around the person's wrist or neck. It should be understood that the badge clip 30 of the present invention is capable of securing the badge 32 to any accessory which is worn or carried by a person.

Figure 6:
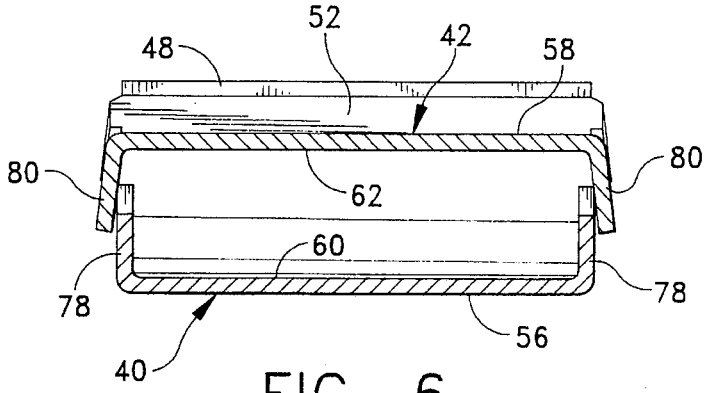
FIG. 6 is a cross-sectional view taken along line 6—6 in FIG. 4.
Figure 7:
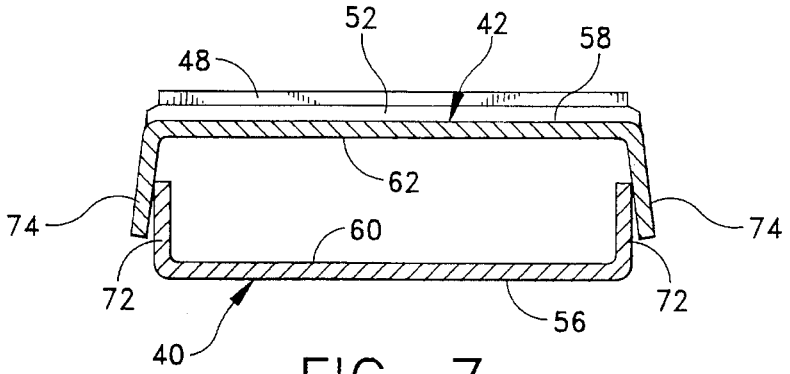
FIG. 7 is a cross-sectional view taken along line 7—7 in FIG. 4.
Figure 8:
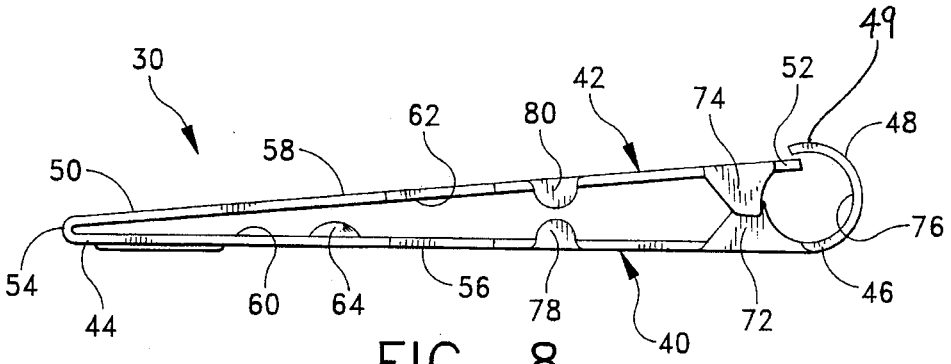
FIG. 8 is a side view of the clip shown in FIG. 3.

Referring now to FIGS. 3–8, the badge clip 30 is integrally formed from spring steel as a one-piece unitary construction, and comprises a fixed leg generally indicated at 40 and a movable leg generally indicated at 42. The fixed leg 40 has a first end portion 44 and an opposite second end portion 46 which has a curled barrel formation 48 the barrel portion 48 having a terminal end 49. The movable leg 42 also has a first end portion 50 which is secured to the first end portion 44 of the fixed leg 40 and an opposite second end portion 52 which is engageable with the curled barrel formation 48 of the fixed leg 40. As best illustrated in FIG. 8, the movable leg 42 is integrally formed with the fixed leg 40 and reversely bent at 54 so as to achieve the represented angular relationship. The fixed and movable legs 40, 42 have outwardly facing surfaces 56, 58 and inwardly facing surfaces 60, 62, respectively.

Figure 9:
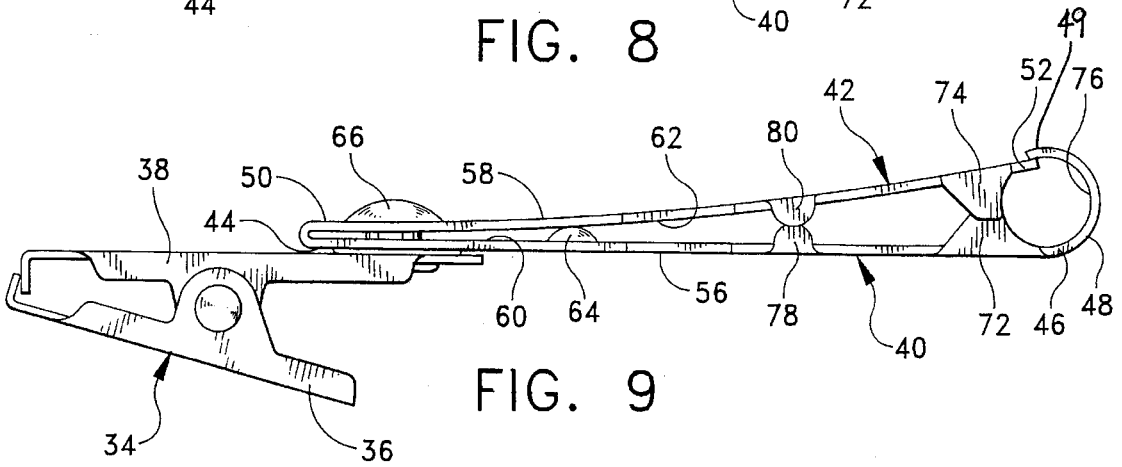
FIG. 9 is a side view similar to FIG. 8 with the clamping device attached thereto.

The movable leg 42 is pivotally movable about its connection to the fixed leg 40 between an open position in which the movable leg 42 is adjacent the fixed leg 40 and the second end portion 52 of the movable leg 42 is spaced from the curled barrel formation 48 as shown in FIG. 8, and a closed position in which the movable leg 42 is angled with respect to the fixed leg 40 and the second end portion 52 of the movable leg 42 engages the curled barrel formation 48 to close the latter. FIG. 9 illustrates the movable leg 42 in its closed position wherein the outwardly facing surface 58 of the leg 42 is in engagement with the end of the curled barrel formation 48.

Still referring to FIG. 9, there is illustrated means of the present invention for biasing the movable leg 42 to its closed position. The biasing means of the present invention includes a pair of detents each indicated at 64 which extend inwardly from the inwardly facing surface 60 of the fixed leg 40 to engage the inwardly facing surface 62 of the movable leg 42 thereby flexing the movable leg 42 in a direction away from the fixed leg 40 after a rivet 66 or other suitable fastener secures the clamping member 38 of the clamping device 34 to the badge clip 30. As shown, a pair of aligned openings, each indicated at 68, formed in the first end portions 44, 50 of respective legs 40, 42 are provided for receiving the rivet 66 therethrough which, in addition to securing the clamping device 34 to the badge clip 30, also draws together the first end portions 44, 50 of the legs 40, 42 together in such a manner that the inwardly facing surfaces 60, 62 of the legs 40, 42 are in facing relation. Thus, this clamping action causes the detents 64 to engage the movable leg 42 so as to act as a fulcrum to flex the movable leg upwardly in the manner illustrated in FIG. 9 wherein it assumes its closed position. The flexing action of the movable leg 42 can be overcome by applying a downwardly directed force against the movable leg 42 wherein it resiliently moves towards the fixed leg 40 to effect opening of the clip.

Figure 11:
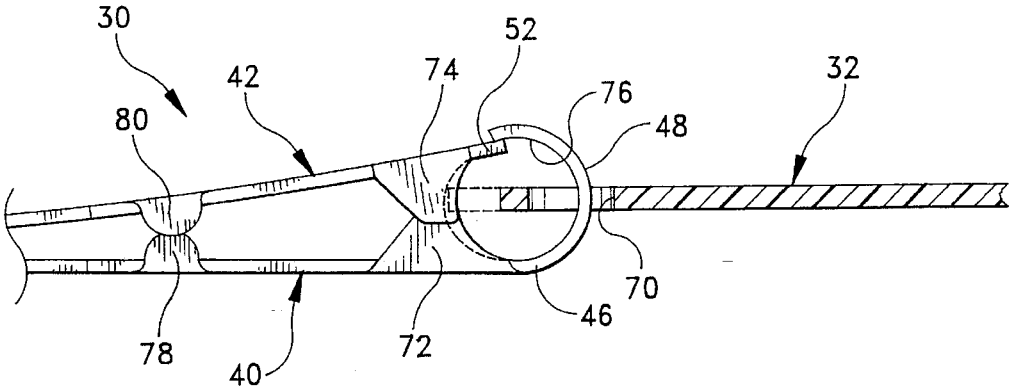
FIG. 11 is a cross-sectional view taken along line 11—11 in FIG. 10.

The arrangement is such that the curled barrel formation 48 of the fixed leg 40 is capable of receiving the badge 32 which has an opening 70 formed therein for securing the badge 32 to the badge clip 30. As illustrated in FIGS. 10 and 11, the curled barrel formation 48 is received through the opening 70 of the badge 32 when the movable leg 42 is in its open position. The badge 32 is secured to the badge clip 30 by releasing the movable leg 42 so that it can return to its normally biased closed position.

The fixed and movable legs 40, 42 are further provided with a pair of interacting side wall portions 72, 74, respectively, which are located adjacent the second end portions 46, 52 of the legs 40, 42. As illustrated in FIG. 7, the side wall portions 72, 74 extend along a plane generally perpendicular to the plane of their respective legs 40, 42. More specifically, the side wall portions 72 associated with the fixed leg 40 extend along a plane perpendicular to the plane of the fixed leg 40 whereas the side wall portions 74 associated with the movable leg 42 are angled outwardly with respect to a vertical plane in a position where the side wall portions 72 of the fixed leg 40 are captured therebetween. The side wall portions 72, 74 limit the degree of inward movement of the legs 40, 42 with respect to each other and further cooperate with the curled barrel formation 48 of the fixed leg 40 for creating an enclosed opening represented by reference numeral 76. As shown in solid lines in FIG. 11, this enclosed opening 76 is circular-shaped. However, as illustrated in broken lines in FIG. 11, the opening can also be oval-shaped so as to accommodate badges having greater widthwise dimensions between the opening 70 and the edge of the badge 32. The pair of side wall portions 72, 74 also cooperate for preventing the badge 32 from sliding down the badge clip 30.

Turning now to FIG. 6, there are another pair of interacting side wall portions 78, 80 for legs 40, 42, respectively, which are positioned between the first pair of side wall portions 72, 74 and the first end portions 44, 50 of the legs. As with the first pair of side wall portions 72, 74, the second smaller side wall portions 78, 80 extend along a plane generally perpendicular to the plane of their respective legs 40, 42 wherein the second side wall portions 78 associated with the fixed leg 40 extend along a plane perpendicular to the plane of the fixed leg 40 and the side wall portions 80 associated with the movable leg 42 are angled slightly outwardly with respect to a vertical plane in a position where the side wall portions 78 of the fixed leg 40 are captured therebetween. The second side wall portions 78, 80 prevent the legs 40, 42 from further contacting each other when moved to their closed position.

As mentioned above, the badge clip 30 is preferably fabricated from spring steel which gives the movable leg 42 the resilient flexing action required to keep it in its closed position. The badge clip 30 is made from one integral part by a progressive tool. After the part has been formed so as to assume the shape illustrated in FIGS. 3–8, it is plated with a protective coating in a well-known manner, as by being immersed in a plating bath. It should be noted, as shown in FIG. 8, that the second end portion 52 of the movable arm 42 is spaced from the end of the curled barrel formation 48 so that when plating occurs, the plating solution can contact the entire surfaces of the portions 48 and 52, and no undesirable sticking of the portions 48 and 52 to each other will take place. Moreover, the first and second pair of side wall portions 72, 74, 78 and 80 prevent nesting of multiple badge clips during their plating.

After the badge clip 30 is formed and plated, the clamping device 34 is attached to the first end portions 44, 50 of the arms 40, 42 of the clip 30 by a permanent fastener, such as the rivet 66. As shown in FIG. 9, the end portions 44, 50 are drawn together so as to engage the movable arm 42 with the detents 64 thereby causing the movable arm 42 to be biased to its closed position where it engages the end of the curled barrel formation 48. The clamping device 34 is provided for clamping the badge clip 30 onto a person's clothing or other article, such as a purse or handbag. The badge 32 is attached to the badge clip 30 by inserting the curled barrel formation 48 into the opening 70 in the badge 32 when the movable leg 42 is held in its open position, and releasing the movable leg 42 so that it resiliently returns to its closed position as illustrated in FIG. 11. In this position the badge 32 is secured to the badge clip 30 and can only be removed therefrom by moving the movable leg 42 back to its open position and removing the curled barrel formation 48 from the opening 70 of the badge 32.

It should be noted that since the badge clip 30 is fabricated from durable spring steel, it does not suffer from the many disadvantages associated with prior art badge clips, such as badge clip 20.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clip assembly for securing a badge to an article of clothing comprising:

a badge clip including a fixed leg having an inwardly facing surface and first and second end portions, said second end portion being reversely bent such that a terminal end of said second end portion is adjacently positioned to said inwardly facing surface, said badge clip further including a movable leg having an inwardly facing surface and first and second end portions, said first end portion of said movable leg being fixedly attached to said first end portion of said fixed leg wherein said second end portion of said movable leg is engageable with the terminal end of the second end portion of the fixed leg, said second end portion of said movable leg being movable between a closed position wherein the second end portion of the movable leg is engaged with the terminal end of the second end portion of said fixed leg and an open position wherein the second end of the movable leg is spaced apart from said terminal end, said badge clip further including means for normally biasing the second end portion of the movable leg to said closed position, said second end portions of said fixed and movable legs having a width which is less than that of a slot formed along a top edge of a badge, said terminal end of said second end portion of said fixed leg being received through said slot whereby said badge is secured to said badge clip; and clamping means attached to said badge clip for releasably clamping said badge clip to an article of clothing.

2. The clip assembly of claim 1 wherein said means for normally biasing said second end portion of said movable leg comprises a detent formed on the inwardly facing surface of one of the fixed and movable legs, and means for securing said first end portions of said fixed and movable legs in facing relation whereby said detent functions as a fulcrum to resiliently bias said second end of said movable leg to said closed position.

3. The clip assembly of claim 2, wherein said detent is formed on the inwardly facing surface of said fixed leg.

4. The clip assembly of claim 2, wherein said means for securing said first end portions of said fixed and movable legs in facing relation comprises a rivet extending through said fixed and movable legs, said rivet further functioning to attach said clamping means to said badge clip.

5. In the clip assembly of claim 1, each of said fixed and movable legs further comprising opposing sidewall portions located adjacent the second end portions of said fixed and movable legs.

6. The clip assembly of claim 1, wherein said reversely bent second end portion of said fixed leg is reversely bent in the shape of a curved barrel.

7. The clip assembly of claim 1, wherein said, first end portion of said movable leg is reversely bent from the first end portion of the fixed leg.

* * * * *